US009328740B2

(12) United States Patent
Fu et al.

(10) Patent No.: US 9,328,740 B2
(45) Date of Patent: May 3, 2016

(54) FAN ASSEMBLY WITH RETAINING MODULE

(71) Applicant: ScienBiziP Consulting (Shen Zhen) Co., Ltd., Shenzhen (CN)

(72) Inventors: Shuang Fu, Shenzhen (CN); Xiao-Wei Xue, Shenzhen (CN)

(73) Assignee: ScienBiziP Consulting(Shenzhen)Co., Ltd., Shenzhen (CN)

( * ) Notice: Subject to any disclaimer, the term of this patent is extended or adjusted under 35 U.S.C. 154(b) by 698 days.

(21) Appl. No.: 13/756,830

(22) Filed: Feb. 1, 2013

(65) Prior Publication Data

US 2013/0272869 A1 Oct. 17, 2013

(30) Foreign Application Priority Data

Apr. 17, 2012 (CN) ..... 2012 1 0112522

(51) Int. Cl.
*F04D 29/64* (2006.01)
*F04D 29/60* (2006.01)
*F04D 25/06* (2006.01)

(52) U.S. Cl.
CPC ..... *F04D 29/644* (2013.01); *F04D 25/0613* (2013.01); *F04D 29/601* (2013.01)

(58) Field of Classification Search
CPC ... F04D 29/601; F04D 29/602; F04D 29/644; F04D 29/646; F04D 19/002; F05D 2240/91; F05D 2260/30
See application file for complete search history.

(56) References Cited

U.S. PATENT DOCUMENTS 5,341,871 A * 8/1994 Stelzer ..... F01P 5/02 165/121
6,406,257 B1 * 6/2002 Houdek ..... H05K 7/20172 415/213.1
6,674,641 B2 * 1/2004 Jensen ..... G06F 1/18 165/80.3
7,259,962 B2 * 8/2007 Chen ..... G06F 1/20 361/695
7,369,408 B2 * 5/2008 Chang ..... F04D 25/0613 165/121
7,641,443 B2 * 1/2010 Chuang ..... F04D 19/007 415/213.1
2007/0217910 A1 * 9/2007 Chang ..... H05K 7/20172 415/213.1

* cited by examiner

*Primary Examiner* — Richard Edgar
*Assistant Examiner* — Juan G Flores
(74) *Attorney, Agent, or Firm* — Novak Druce Connolly Bove + Quigg LLP

(57) ABSTRACT

A fan assembly includes a fan, a bracket, and a retaining member. The fan defines a locking hole. A bracket receives the fan. The bracket includes a mounting wall. The retaining member includes a base panel and a mounting portion. The mounting portion includes a mounting tab extending from the base panel and a mounting protrusion extending from the mounting tab. The mounting protrusion extends through the mounting wall and inclining resists an inner side of the locking hole to prevent the fan from moving along a first direction substantially parallel to the mounting wall.

18 Claims, 4 Drawing Sheets

FAN ASSEMBLY WITH RETAINING MODULE

BACKGROUND

The disclosure generally relates to fan retaining modules typically used in computer systems.

Description of Related Art

Heat dissipation devices, such as fans, are provided in. Typically, one or more of these fans are directly screwed onto a rack adjacent to the heat generating components in the computer. However, the process of assembly is time-consuming. There is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
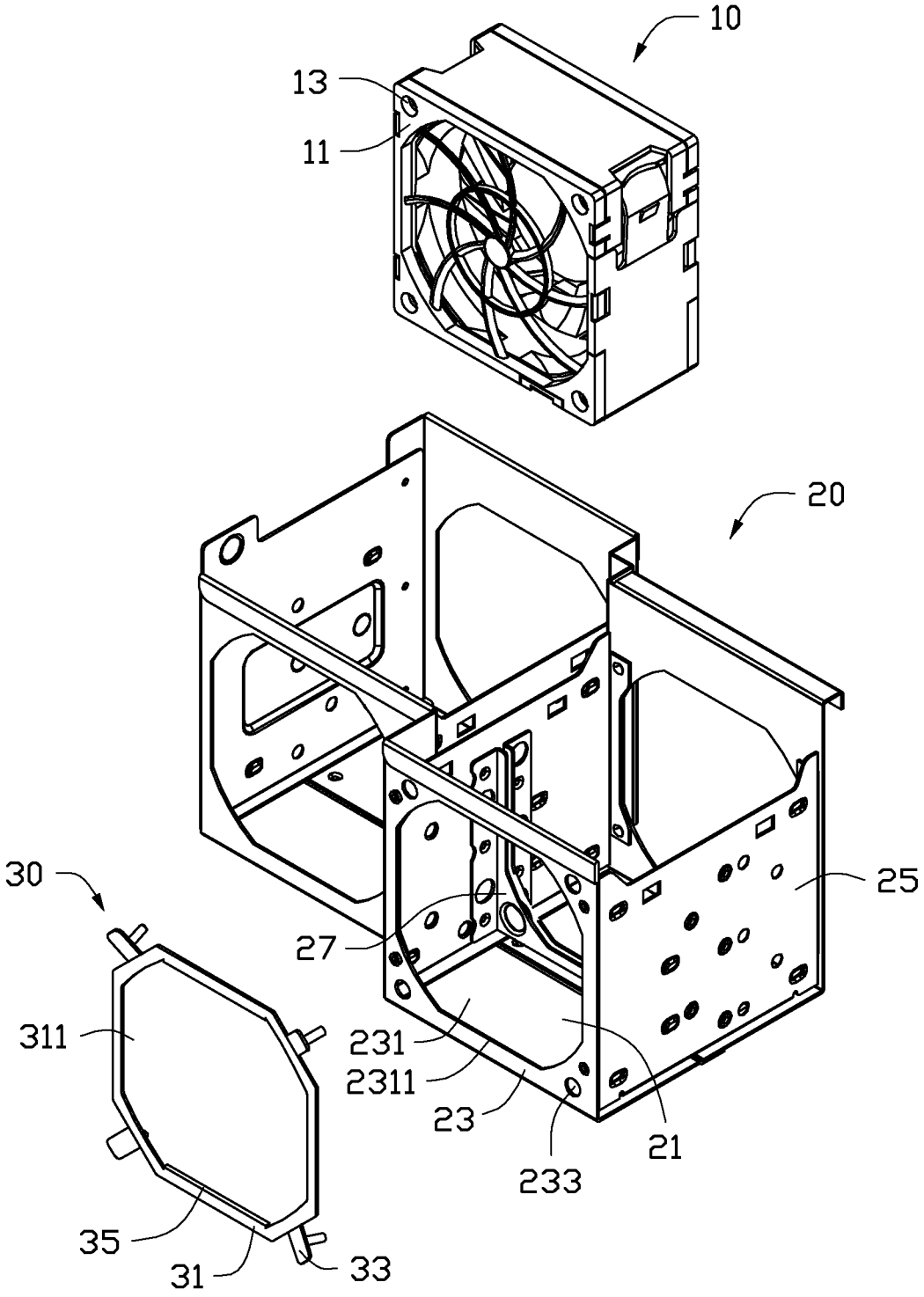
FIG. 1 is an exploded, isometric view of a fan assembly of one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one."

FIG. 1 shows one embodiment of a fan assembly. The fan assembly includes a retaining module for receiving a plurality of fans 10 (only one shown in the embodiment). The retaining module includes a bracket 20 and a retaining member 30.

The fan 10 defines a plurality of locking holes 13 in a front side 11. In the illustrated embodiment, there are four locking holes 13 in four corners of the front side 11 of the fan 10. Two of locking holes 13 are located in a first diagonal line of the front side 11 and the other two of locking holes 13 are located in a second diagonal line of the front side 11.

The bracket 20 includes a bottom wall 21, a mounting wall 23 extending from the bottom wall 21, two side walls 25, substantially parallel to each other, extending from the bottom wall 21, and an interval wall 27 extending from the bottom wall 21. The mounting wall 23, the two side walls 25, and the interval wall 27 are substantially parallel to the bottom wall 21. The interval wall 27 is substantially parallel to the mounting wall 23. The two side walls 25 are substantially perpendicular to the mounting wall 23. The mounting wall 23 defines a vent 231, for allowing airflow from the fan 10 to blow therethrough. The mounting wall 23 is substantially square. The mounting wall 23 defines four securing holes 233 at all four corners corresponding to the locking holes 13. The vent 231 defines two contacting edges 2311.

Figure 2:
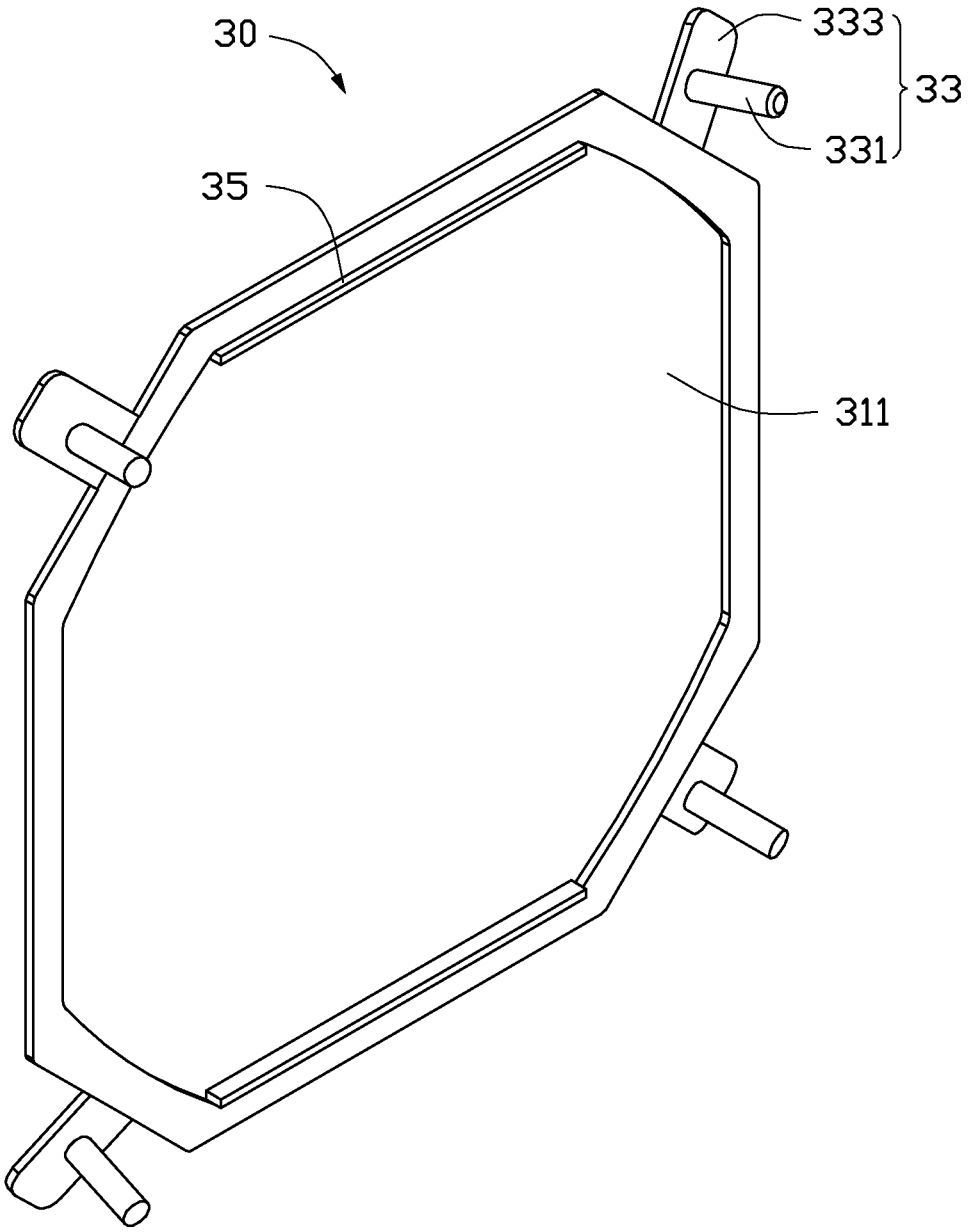
FIG. 2 is an enlarged, isometric view of a retaining member of FIG. 1, showing another aspect thereof.
Figure 3:
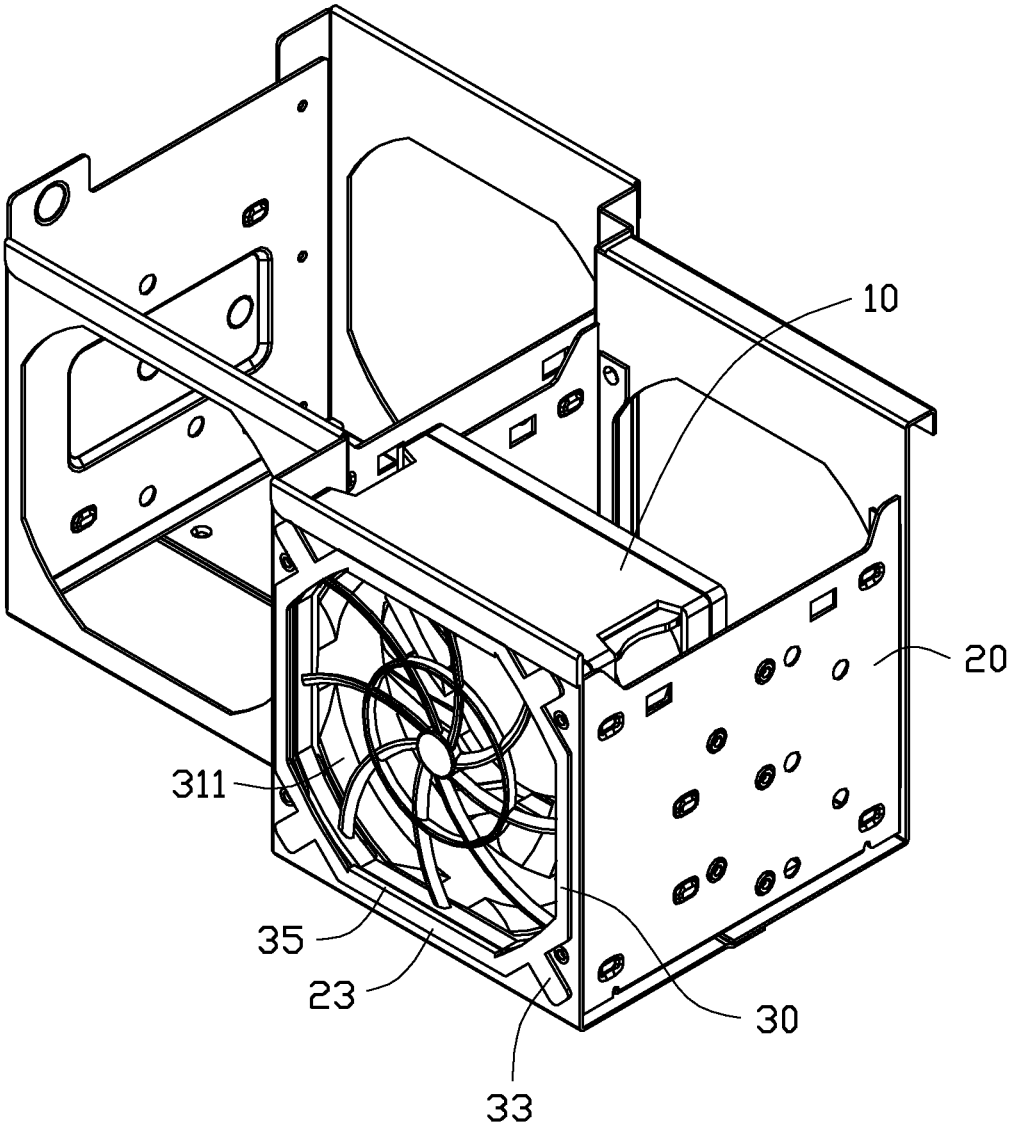
FIG. 3 is an assembled view of the fan assembly of FIG. 1.
Figure 4:
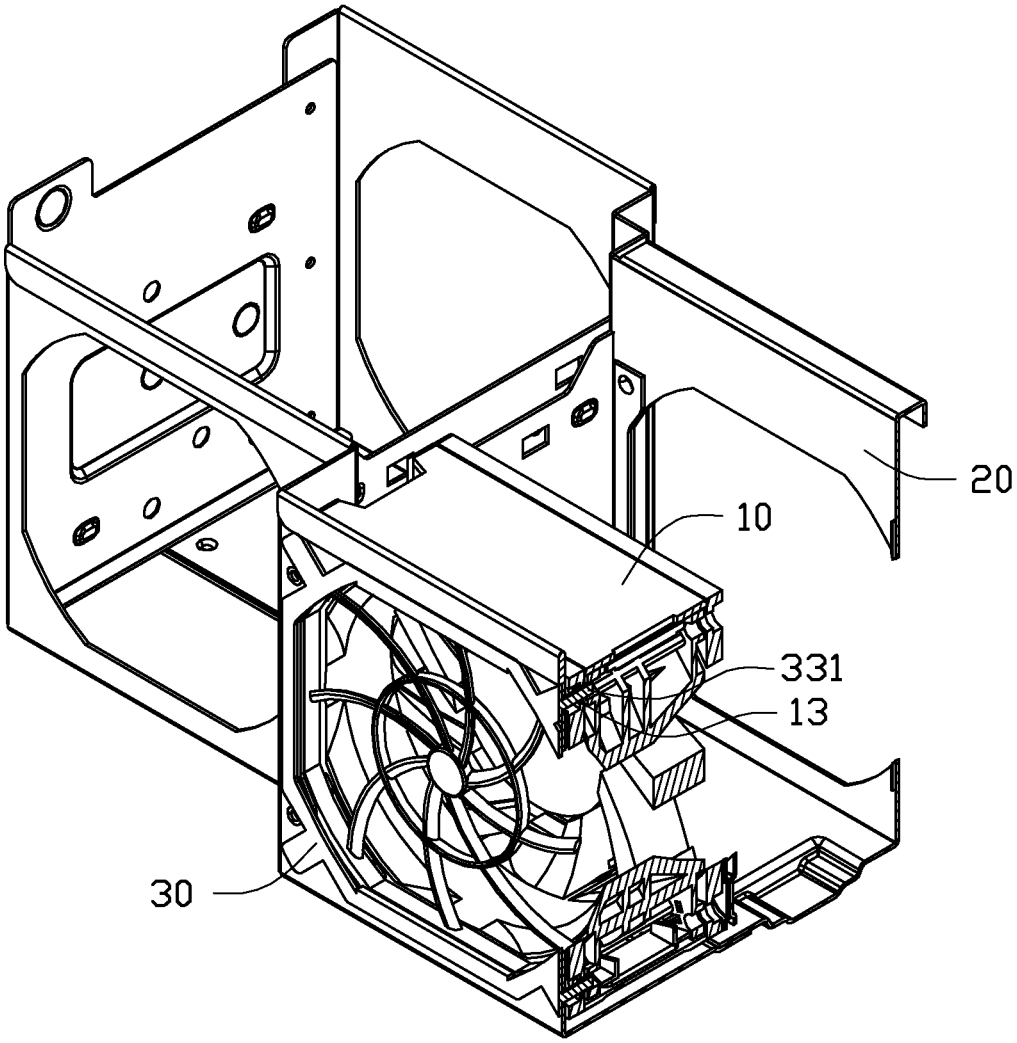
FIG. 4 is a cutaway view of a bracket and the retaining member of FIG. 1 when assembled.

FIG. 2 shows that the retaining member 30 is substantially square. The retaining member 30 includes a base panel 31, four mounting portions 33 located at four corners of the base panel 31, and two retaining portions 35 located on opposite top and bottom sides of the base panel 31. The two retaining portions 35 are substantially parallel to each other and perpendicular to the base panel 31. The base panel 31 is substantially parallel to the mounting wall 23. An opening 311 is defined in the base panel 31 corresponding to the vent 231 of the mounting wall 23. Each mounting portions 33 includes a mounting tab 333 extending from the base panel 31 and a mounting protrusion 331, extending from the mounting tab 333. The mounting protrusion 331 is substantially perpendicular to the mounting tab 333. An obtuse angle is defined between the mounting tab 333 and the base panel 31, to enable the mounting protrusion 331 to be at an obtuse angle relative to the base panel 31.

FIG. 1 to FIG. 4 show that in assembly, the fan 10 is placed between the mounting wall 23 and the interval wall 27 of the bracket 20, to enable the locking holes 13 of the front side 11 of the fan 10 to be aligned with the securing holes 233 of the mounting wall 23. At this time, the fan 10 is prevented from moving along a direction substantially perpendicular to the mounting wall 23. Two mounting protrusions 331 of the retaining member 30 are inserted into two corresponding securing holes 233 and two corresponding locking holes 13. The base panel 31 of the retaining member 30 is biased to enable the other mounting protrusions 331 to be inserted into the corresponding securing holes 233 and the corresponding locking holes 13. At this time, the mounting protrusions 331 incliningly resist the inner surface of the locking holes 13 to secure the retaining member 30 to the bracket 20, and the fan 10 is prevented from moving along a direction substantially parallel to the mounting wall 23. The mounting tabs 333 are deformed to be in the same plane with the base panel 31. The retaining portions 35 are received in the vent 231 and contact the two contacting edges 2311 to prevent the retaining member 30 from moving along the direction substantially parallel to the mounting wall 23.

When detaching the fan 10 from the bracket 20, one side of the retaining member 30 is pulled away from the mounting wall 23 of the bracket 20, to enable two of the mounting protrusions 331 to disengage from the two locking holes 13 and the two securing holes 233. The other side of the retaining member 30 is pulled away from the mounting wall 23 again, to enable the other mounting protrusions 331 to move out of the other locking holes 13 and the securing holes 233. The fan 10 can then be drawn vertically out from the bracket 20.

It is to be understood, however, that even though numerous characteristics and advantages have been set forth in the foregoing description of embodiments, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A retaining module for securing a fan with a locking hole, comprising:

a bracket for receiving the fan, the bracket comprises a bottom wall, a mounting wall extending from the bottom wall, and an interval wall extending from the bottom wall; the mounting wall and the interval wall are configured to receive the fan therebetween to prevent the fan from moving along a first direction substantially perpendicular to the mounting wall; and the mounting wall defining a securing hole; and a retaining member, the retaining member comprising a base panel and a mounting portion, extending from the base panel; the mounting portion comprises a mounting tab extending from the base panel and a mounting protrusion extending from the mounting tab, the mounting protrusion is configured to pass through the securing hole, a first angle is defined between the mounting protrusion and the base panel to enable the mounting protrusion to incliningly resist an inner side of the locking hole of the fan to prevent the fan from moving a second direction substantially parallel to the mounting wall.

2. The retaining module of claim 1, wherein a second angle is defined between the mounting tab and the base panel.

3. The retaining module of claim 2, wherein the mounting protrusion is substantially perpendicular to the mounting tab.

4. The retaining module of claim 1, wherein the retaining member further comprises a first retaining portion extending from the base panel; the mounting wall defines a vent; the vent defines a first contacting edge; and the first retaining portion contacts the first contacting edge, to prevent the retaining member from moving along a third direction substantially parallel to the mounting wall.

5. The retaining module of claim 4, wherein the first retaining portion is substantially perpendicular to the base panel.

6. The retaining module of claim 4, wherein the retaining member further comprises a second retaining portion extending from the base panel, and the first retaining portion and the second retaining portion extend from two edges of the vent.

7. The retaining module of claim 1, wherein the base panel is substantially parallel to the mounting wall.

8. The retaining module of claim 1, wherein the bracket further comprises two side walls extending from the bottom wall; and the two side walls are substantially perpendicular to the bottom wall, the mounting wall, and the interval wall.

9. A fan assembly, comprising:

a fan, the fan comprising a front side, the front side defining two first locking holes located in a first diagonal line of the front side;

a bracket receiving the fan, the bracket comprises a mounting wall; and a retaining member comprising a base panel and two first mounting portions; each of the first mounting portions comprises a first mounting tab extending from the base panel and a first mounting protrusion extending from the first mounting tab; and the two first mounting protrusions extending through the mounting wall and incliningly resist inner sides of the two first locking holes to prevent the fan from moving along a first direction substantially parallel to the mounting wall.

10. The fan assembly of claim 9, wherein a first angle is defined between the first mounting protrusion and the base panel.

11. The fan assembly of claim 10, wherein a second obtuse angle is defined between the first mounting tab and the base panel.

12. The fan assembly of claim 11, wherein the first mounting protrusion is substantially perpendicular to the mounting tab.

13. The fan assembly of claim 10, wherein the retaining member further comprises a first retaining portion extending from the base panel; the mounting wall defines a vent; the vent defines a first contacting edge; the first retaining portion contacts the first contacting edge to prevent the retaining member from moving along a third direction substantially parallel to the mounting wall.

14. The fan assembly of claim 13, wherein the first retaining portion is substantially perpendicular to the base panel.

15. The fan assembly of claim 13, wherein the retaining member further comprises a second retaining portion extending from the base panel, and the first retaining portion and the second retaining portion extend from two edges of the vent.

16. The fan assembly of claim 9, wherein the base panel is substantially parallel to the mounting wall.

17. The fan assembly of claim 9, wherein the bracket further comprises a bottom wall, an interval wall extending from the bottom wall, and two side walls extending from the bottom wall; and the two side walls are substantially perpendicular to the bottom wall, the mounting wall, and the interval wall.

18. The fan assembly of claim 9, wherein the front side defines two second locking holes located in a second diagonal line of the front side; the retaining member comprises two second mounting portions; each of the second mounting portions comprises a second mounting tab extending from the base panel and a second mounting protrusion extending from the second mounting tab; and the two second mounting protrusions extend through the mounting wall and incliningly resist inner sides of the two second locking holes to prevent the fan from moving along the first direction substantially parallel to the mounting wall.

* * * * *